United States Patent [19]

Takashima

[11] Patent Number: 5,067,453

[45] Date of Patent: Nov. 26, 1991

[54] PISTON OF TWO-CYCLE ENGINE

[75] Inventor: Kazutoshi Takashima, Hamamatsu, Japan

[73] Assignee: Sanshin Kogyo Kabushiki Kaisha, Hamamatsu, Japan

[21] Appl. No.: 578,934

[22] Filed: Sep. 7, 1990

[30] Foreign Application Priority Data

Sep. 7, 1989 [JP] Japan ..... 1-232453

[51] Int. Cl.[5] ..... F02F 3/00

[52] U.S. Cl. ..... 123/193 P; 123/572

[58] Field of Search ..... 123/193 P, 572

[56] References Cited

U.S. PATENT DOCUMENTS

| | | | |
|---|---|---|---|
| 3,667,443 | 6/1972 | Currie et al. | 123/193 P |
| 4,111,104 | 9/1978 | Davison | 123/193 P |
| 4,711,201 | 12/1987 | Ooyama et al. | 123/193 P |

FOREIGN PATENT DOCUMENTS

| | | | |
|---|---|---|---|
| 0153452 | 8/1985 | Japan | 123/193 P |
| 0153453 | 8/1985 | Japan | 123/193 P |
| 0233455 | 10/1987 | Japan | 123/193 P |
| 0299364 | 12/1989 | Japan | 123/193 P |

*Primary Examiner*—Andrew M. Dolinar
*Assistant Examiner*—M. Macy
*Attorney, Agent, or Firm*—Ernest A. Beutler

[57] ABSTRACT

Two embodiments of piston constructions for two-cycle, crankcase compression, internal combustion engines wherein the piston is formed with a blow by passage so that blow by gases escaping past the piston rings will not pass across the skirt portion of the piston to deteriorate the lubricant thereon. In one embodiment, holes formed in the piston permit the blow by gases to flow into the interior of the piston and in another embodiment, the piston pin boss is formed with a relief that permits the blow by gases to exit through one of the scavenge passages.

20 Claims, 5 Drawing Sheets

PISTON OF TWO-CYCLE ENGINE

BACKGROUND OF THE INVENTION

This invention relates to a piston for a two-cycle engine and more particularly to an improved piston construction for such engines.

As is well known, it is extremely important to maintain adequate lubricant between the skirt of a piston and the associated cylinder bore. This problem is particularly acute in conjunction with two cycle engines since the piston is normally lubricated by lubricant that is delivered to the engine through its induction system. Frequently, this lubricant is mixed with the fuel of the engine.

In order to provide lubrication for the piston skirt, it has been proposed to form a groove in the head of the piston below the piston ring grooves to which oil is delivered from the interior of the piston through one or more holes. Although such an arrangement is effective for lubricating the piston, the blow by gases which escape past the piston rings can not only blow the lubricant away from the area on the piston skirt but also can cause carbon to form in the lubricant because of the high temperature of the blow by gases. If the lubricant is either blown away or deteriorated by carbonization, then obvious problems can result.

It is, therefore, a principal object of this invention to provide an improved piston construction wherein the piston will be lubricated and the lubricant will not be damaged or deteriorated by the blow by gases.

It is a further object of this invention to provide an improved piston construction for a two-cycle internal combustion engine.

SUMMARY OF THE INVENTION

This invention is adapted to be embodied in a piston for an internal combustion engine having a head formed with at least one ring groove and receiving a piston ring therein. A skirt portion is formed below the head and has arcuate portions adapted to face the cylinder bore. Piston pin bosses are formed between these skirt portions and adapted to receive a piston pin to connect the piston to a connecting rod. A blow by passage is formed in the piston for directing blow by gases escaping past the piston ring to an area away from the skirt portions to avoid deterioration of the lubricant on the skirt portion.

DETAILED DESCRIPTION OF THE PREFERRED EMBODIMENTS

Figure 1:
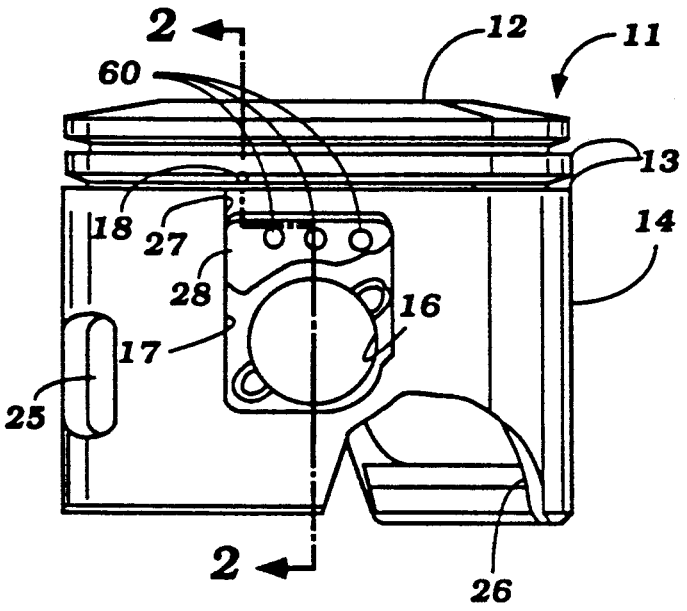
FIG. 1 is a side elevational view of a piston for an internal combustion invention of the two-cycle type and constructed in accordance with a first embodiment of the invention.
Figure 2:
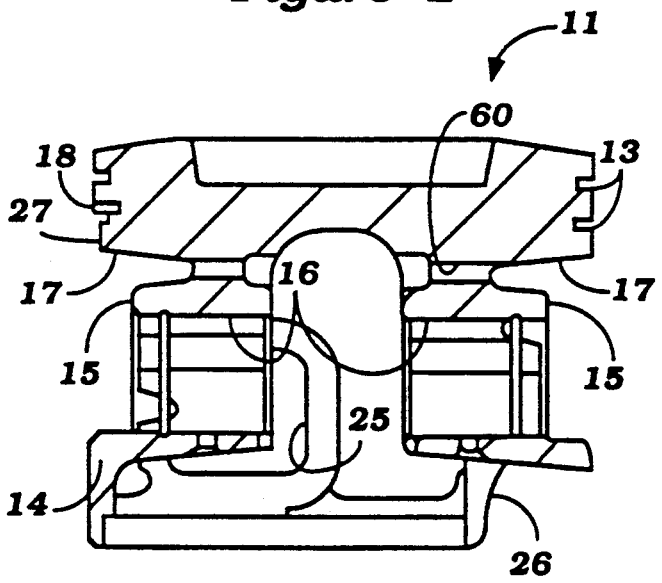
FIG. 2 is a cross-sectional view taken along the line 2—2 of FIG. 1.
Figure 3:
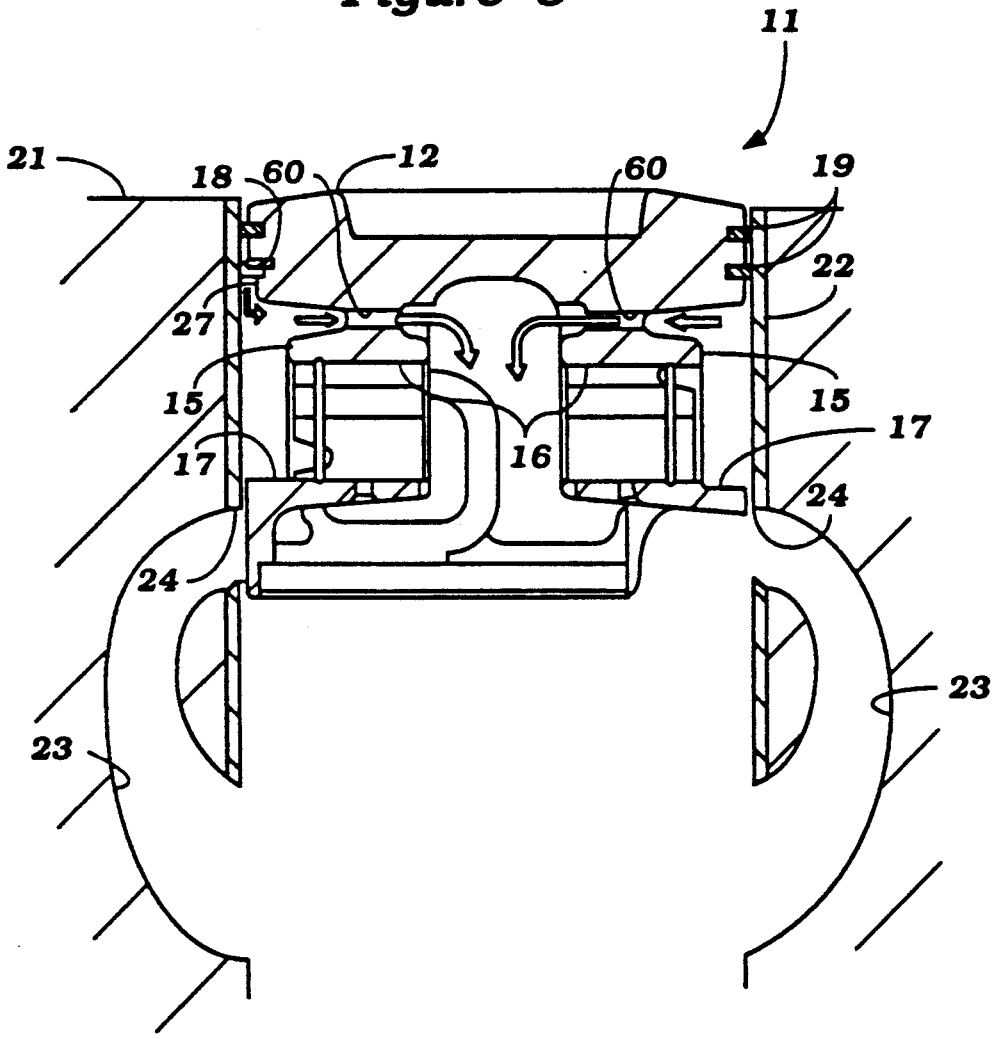
FIG. 3 is a cross-sectional view through a single cylinder of the engine showing how the piston of this embodiment cooperates to avoid problems caused by blow by gases.
Figure 4:
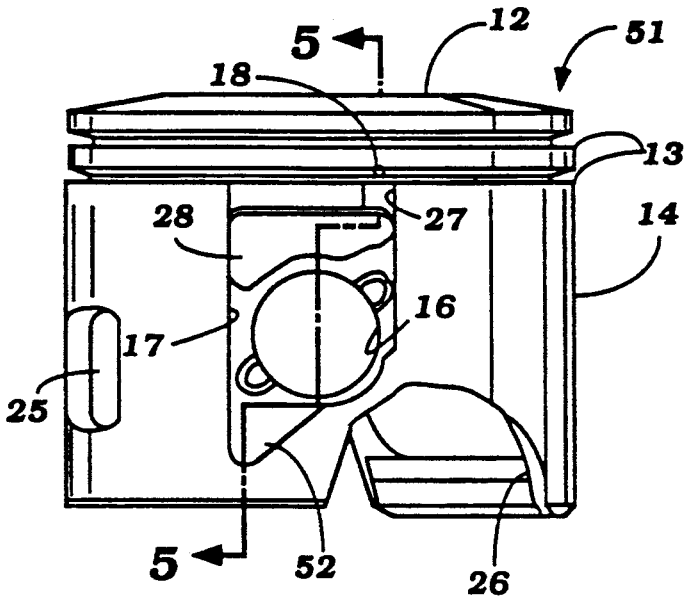
FIG. 4 is a side elevational view, in part similar to FIG. 1, of a piston constructed in accordance with another embodiment of the invention.
Figure 5:
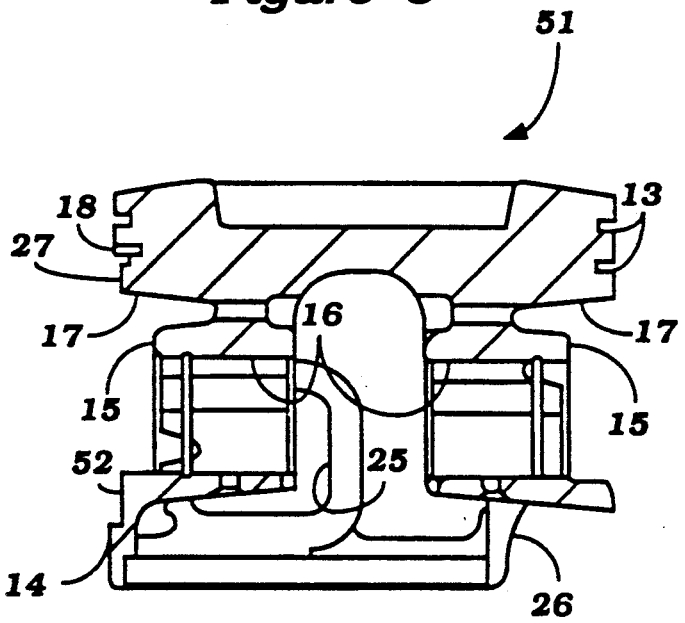
FIG. 5 is a cross-sectional view taken along the line 5—5 of FIG. 4.
Figure 6:
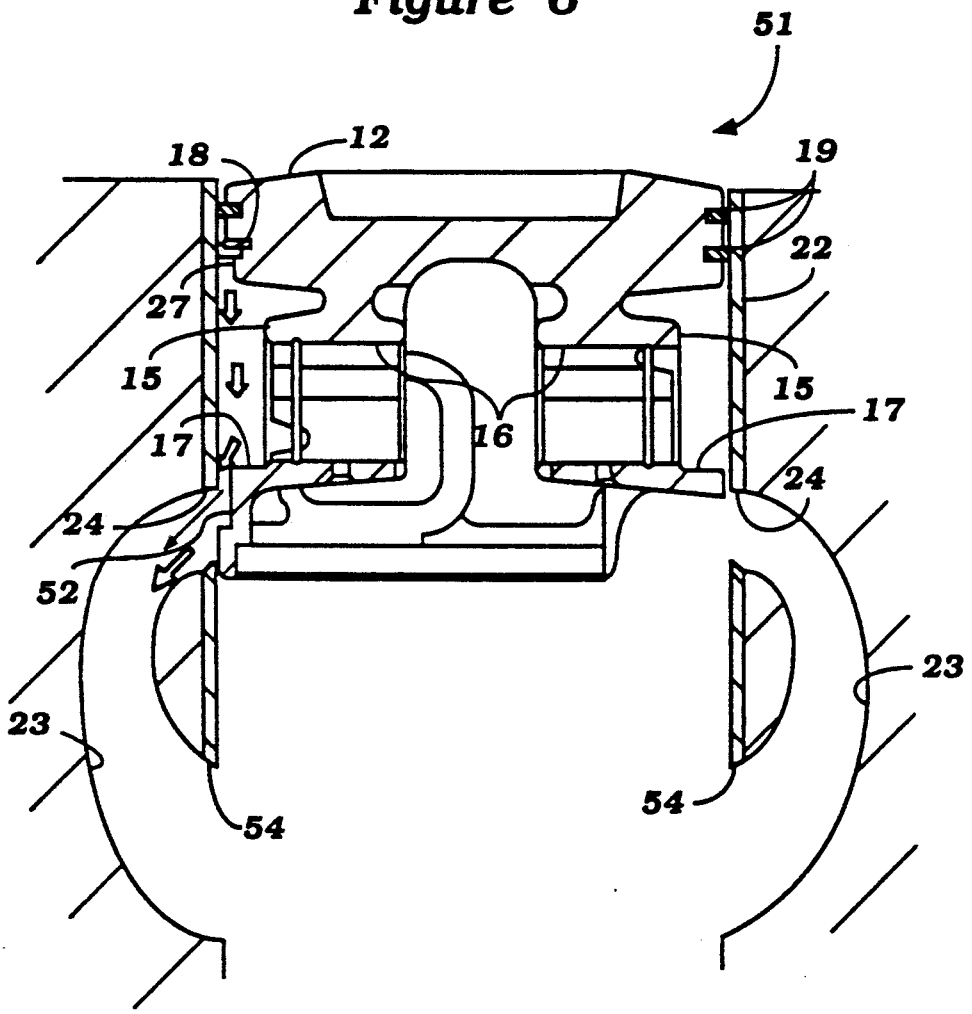
FIG. 6 is a view, in part similar to FIG. 3, showing how the piston in this embodiment cooperates to avoid the effects of blow by gases.

A piston constructed in accordance with a first embodiment of the invention is depicted in FIGS. 1 through 3 and is identified generally by the reference numeral 11. The piston 11 may be formed in any known manner, as by casting and/or forging, from a light alloy material and includes a head portion 12 in which a pair of piston ring grooves 13 are provided. Below the head portion 12, the piston 11 is provided with a skirt portion 14 which is comprised of a pair of spaced apart cylindrical sections which are disposed on opposite sides of piston pin bosses 15. The piston pin bosses 15 are formed with bores 16 that receive a piston ring for connecting the piston 11 to an associated connecting rod (not shown). The piston pin bosses 15 are formed generally within relief areas 17 that are formed in the respective skirt portions 14.

As is typical with two-cycle engine practice, retaining pins 18 are pressed into one or all of the piston ring grooves 13 and are adapted to be received in the grooves formed in the piston rings 19 (FIG. 3) so as to avoid rotation of the piston rings 19 in the grooves 13. This is done so as to orient the piston ring grooves relative to the ports of the engine so that they will not pass across the port area, as is well known in this art.

Referring now to FIG. 3, the piston 11 is adapted to be received in a cylinder block, indicated generally by the reference numeral 21, and specifically within a cylinder bore formed in a liner 22 thereof. This liner 22 and the associated cylinder block 21 are formed with exhaust and scavenge ports. Two scavenge passages 23 appear in FIG. 3 and they terminate in respective scavenge ports 24 formed in the liner 22. Normally there will be a third scavenge passage which is not shown and which is disposed approximately midway between the scavenge ports 24.

The skirt 14 of the piston 11 is formed with respective relief openings 25 and 26 which cooperate with the respective ports so as to provide adequate breathing and the appropriate timing of the port opening and closing.

In accordance with the invention, an arrangement is provided so as to direct the exhaust gases which may blow past the piston rings 19 to an area away from the skirt portions 14. This will insure against blowing lubricant away from the skirt portion 14 and further will insure against overheating of the lubricant in this area and carbonization of it.

To this end, the reliefs 17 are provided with bypass relief passages 27 that extend from the head portion 12 in the area of the locating pin 18 to the piston pin boss relief 17. A flat surface 60 of each boss 15 is provided with a plurality of relief holes 28 so that the blow by gases will flow past the piston rings 19 and into the interior of the piston 11 as shown by the arrows in FIG. 3. These blow by gases may then actually pass back into the crankcase chambers through the scavenge ports 24 and scavenge passages 23. It should be noted that this condition occurs primarily when the piston 11 is at or approaching the top dead center position as shown in FIG. 3 as this is the time when the pressure in the associated combustion chamber is the highest.

FIGS. 4 through 7 show another embodiment of the invention which is generally the same as the embodiment thus far described. For that reason, components of this embodiment which are the same or substantially the same as the preceding embodiment have been identified by the same reference numeral and will be described again only insofar as is necessary to understood the construction and operation of this embodiment.

Figure 7:
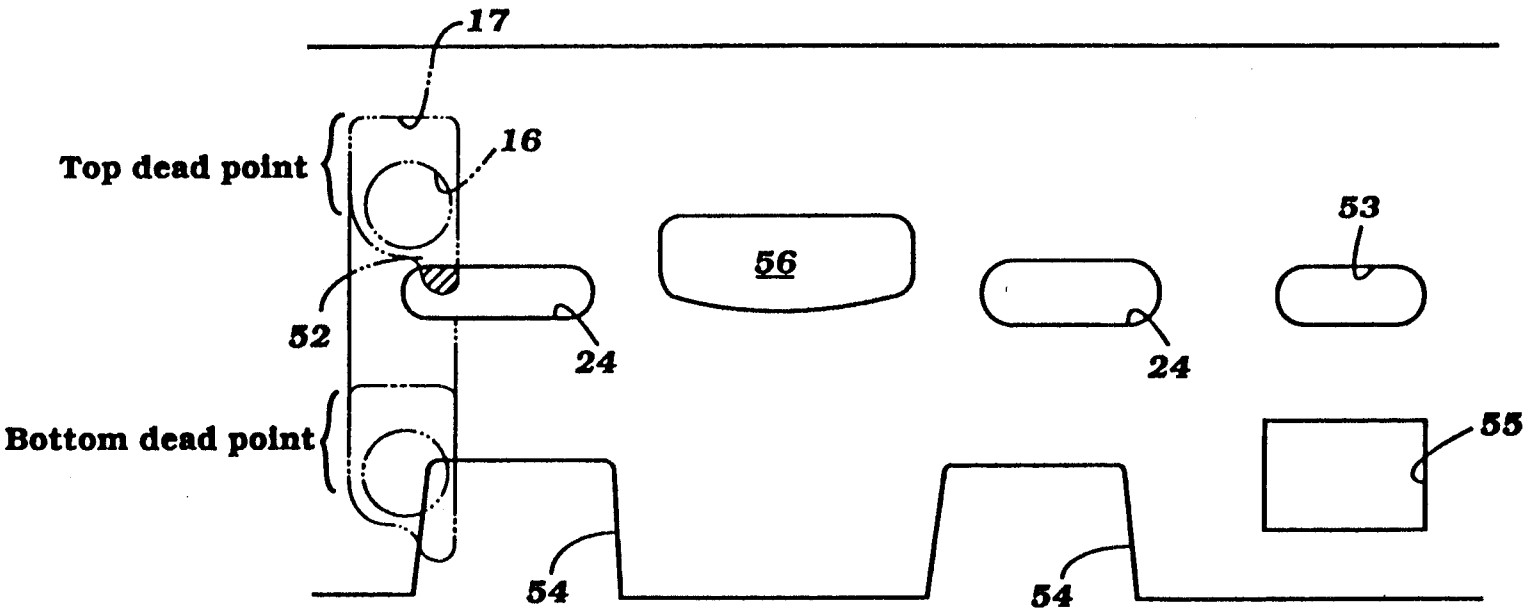
FIG. 7 is a developed view showing the blow by gas relief arrangement and its relationship to the ports of this embodiment.

In this embodiment, the piston, indicated generally by the reference numeral 51, has the same basic components as aforenoted. However, in this embodiment, the apertures 28 are eliminated. Rather, the blow by relief passage 27 cooperates with the recess 17 and an extending portion 52 of this recess is formed which will be aligned with one of the scavenge ports 24 when the piston is at its top dead center position as shown in FIG. 7. Hence, when the piston 51 approaches its top dead center position, the blow by gases may exit as shown in the arrows in FIG. 6 so as to avoid any blow by gases passing across the skirt area of the piston. Thus, this embodiment achieves the same results as the previously described embodiment.

It should be noted that in this embodiment and specifically in the developed view of FIG. 7, the center scavenge port, indicated generally by the reference numeral 53, also appears. In addition, the inlet portions 54 of the main scavenge passages 23 also are shown. There is further shown the inlet 55 of the third or center scavenge passage in this figure.

The exhaust port is also illustrated and it lies between the main scavenge ports 24 and is identified by the reference numeral 56.

It should be readily apparent from the foregoing description that the described construction is highly effective in permitting the blow by gases to exit from the head of the piston area past the grooves in the piston rings without blowing across the skirt area and causing the deleterious effects attendant thereto. Of course, the embodiments of the invention illustrated and described are preferred embodiments of the invention and various changes and modifications may be made without departing from the spirit and scope of the invention, as defined by the appended claims.

I claim:

1. A piston for an internal combustion engine having a head formed with one ring groove means receiving piston ring means therein, a skirt portion formed below said head and having arcuate portions adapted to face a cylinder bore, a pair of piston pin bosses for receiving a piston pin to connect said piston to a connecting rod, and a blow by passage formed at least in part in the exterior surface of said piston below said ring groove means for directing blow by gases escaping past said piston ring to an area away from said skirt portion to avoid deterioration of lubricant on said skirt.

2. A piston as set forth in claim 1 wherein lubricant is delivered to the piston below the piston ring groove means.

3. A piston as set forth in claim 1 wherein the blow by passage extends from an area below the piston ring groove means to the piston pin boss.

4. A piston as set forth in claim 3 wherein the blow by passage further discharges the blow by gases internally of the piston.

5. A piston as set forth in claim 4 wherein the blow by passage delivers the blow by gases internally of the piston through a plurality of apertures formed in the piston pin boss.

6. A piston as set forth in claim 5 wherein lubricant is delivered to the piston below the piston ring groove means.

7. A piston as set forth in claim 3 wherein the blow by passage delivers the blow by gases across the piston pin boss and between the skirt portions.

8. A piston for a two-cycle, crankcase compression engine having scavenge ports said piston having ahead formed with at least one ring groove receiving a piston ring therein, a skirt portion formed below said head and having arcuate portions adapted to face a cylinder bore, a pair of piston pin bosses for receiving a piston pin to connect said piston to a connecting rod, and a blow by passage formed in said piston extending from an area below said piston ring groove for directing blow by gases escaping past said piston ring to an area across said piston pin bosses between said skirt portions to avoid deterioration of lubricant on said skirt portions through the scavenge passage the piston pin bosses.

9. A piston as set forth in claim 8 wherein lubricant is delivered to the piston below the piston ring groove.

10. A piston as set forth in claim 1 further including locating means adapted to be received in the gap of the piston ring for retaining the piston ring against rotation in the piston ring groove.

11. A piston as set forth in claim 10 wherein the locating means is juxtaposed to one of the piston pin bosses.

12. A piston as set forth in claim 11 wherein the blow by passage extends from an area below the piston ring groove means to the piston pin boss.

13. A piston as set forth in claim 12 wherein the blow by passage further discharges the blow by gases internally of the piston.

14. A piston as set forth in claim 13 wherein the blow by passage delivers the blow by gases internally of the piston through a plurality of apertures formed in the piston pin boss.

15. A piston as set forth in claim 14 wherein lubricant is delivered to the piston below the piston ring groove means.

16. A piston as set forth in claim 12 wherein the blow by passage delivers the blow by gases across the piston pin boss and between the skirt portions.

17. A piston as set forth in claim 16 in combination with a two-cycle, crankcase compression engine having scavenge ports and wherein the blow by gases are discharged through the scavenge passage through the piston pin bosses.

18. A piston as set forth in claim 17 wherein lubricant is delivered to the piston below the piston ring groove.

19. A piston as set forth in claim 8 wherein the blow by passage is formed in part in an extension of the piston pin bosses.

20. A piston as set forth in claim 17 wherein the blow by passage is formed in part in an extension of the piston pin bosses.

* * * * *